US005168803A

United States Patent [19]

Kunz et al.

[11] Patent Number: 5,168,803

[45] Date of Patent: Dec. 8, 1992

[54] BAND LINE PRINTER WITH GROOVED PLATEN

[75] Inventors: Barton H. Kunz, Owego; Lawrence A. Stone, Endicott, both of N.Y.

[73] Assignee: International Business Machines Corporation, Armonk, N.Y.

[21] Appl. No.: 664,254

[22] Filed: Mar. 4, 1991

[51] Int. Cl.[5] ..... B41J 1/20; B41J 11/08

[52] U.S. Cl. ..... 101/93.14; 400/146; 400/656

[58] Field of Search ..... 101/93.13, 93.14, 111; 400/146, 656

[56] References Cited

U.S. PATENT DOCUMENTS 4,211,166 7/1980 Hardt ..... 101/93.14
4,510,862 4/1985 Alt et al. ..... 101/93.14

FOREIGN PATENT DOCUMENTS 67261 6/1981 Japan ..... 101/93.14

*Primary Examiner*—Edgar S. Burr
*Assistant Examiner*—Stephen R. Funk
*Attorney, Agent, or Firm*—John S. Gasper

[57] ABSTRACT

A platen for a line printer has a polymer wear resistant strip on a base support. To reduce frictional drag on the band which is in sliding engagement with the wear strip, the leading edge of the strip is slanted against the direction of motion of the band and is provided with grooves that run perpendicular with the leading edge.

2 Claims, 2 Drawing Sheets

BAND LINE PRINTER WITH GROOVED PLATEN

FIELD OF THE INVENTION

This invention relates to printing apparatus and particularly to impact line printers using an engraved type carrier band.

BACKGROUND OF THE INVENTION

Impact line printers use an endless type band which is impacted by print hammers arranged in a row. The band is commonly made of metal such as steel on which a row of raised characters and timing marks have been formed on one side. The drive system for revolving the metal band commonly comprises a pair of pulleys one of which is the drive pulley and the other an idler pulley. The band is trained around the pulleys in tension with the reverse side of the band in contact with the pulley so as to be driven by friction. It is customary to provide a platen of metal or other hard material behind the band in the areas between the pulleys as backup to the band. A flat surface of the platen engages the band at all times. The continuous sliding contact of the type band on the platen punctuated by the frequent impacts of the hammer causes the band and platen to wear to the point where one or both must be replaced. Various wear prevention means have been provided to reduce or eliminate the wear. Among these is a wear prevention layer or strip bonded to the face of the platen. Usually the material is one that has low friction properties and is resistant to deformation by impact. One such material used on printers such as the IBM 6262 Printer is a polymer. In such printers it is customary to operate the band drive at speeds of 100–700 inches per second.

In printers using such a platen, a problem with the band drive motor develops after a period of time where the motor current required to maintain band speed constant at the desired level increases to the point where the motor becomes overheated and reliability and safety elements of the printer controls terminate printer operation. It was determined that the motor problem was due to the increased loading on the drive motor by the band. It was discovered that the increased loading was due to increased frictional drag brought about by the wear and polishing of the wear strip as a consequence of the sliding engagement of band and the strip. The problem has been observed at band speeds as low as 120 inches per second and occurs even where lubricant such as PTFE is applied to the band platen interface.

SUMMARY OF THE INVENTION

Basically the invention solves the problem by providing a platen where surface breaks are formed in the leading edge of the wear surface of the wear prevention strip. In the preferred embodiment, the surface breaks take the form of grooves. In addition, the leading edge of the wear strip is a straight edge and is preferably slanted against the direction of band travel and the grooves are perpendicular to the leading edge. As a consequence, the frictional drag is reduced and the loading on the band drive motor remains essentially constant and within its tolerable range.

The foregoing as well as other advantages will become readily apparent from the following description of a preferred embodiment of the invention.

DETAILED DESCRIPTION OF THE INVENTION

Figure 1:
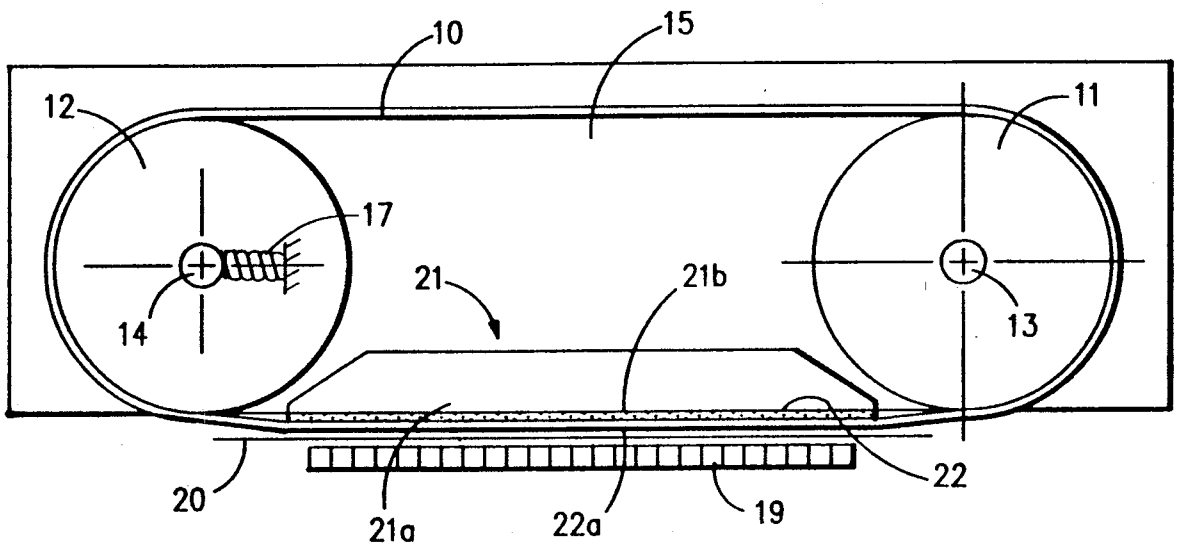
FIG. 1 is a schematic plan view of a printer apparatus in which the invention is incorporated.
Figure 2:
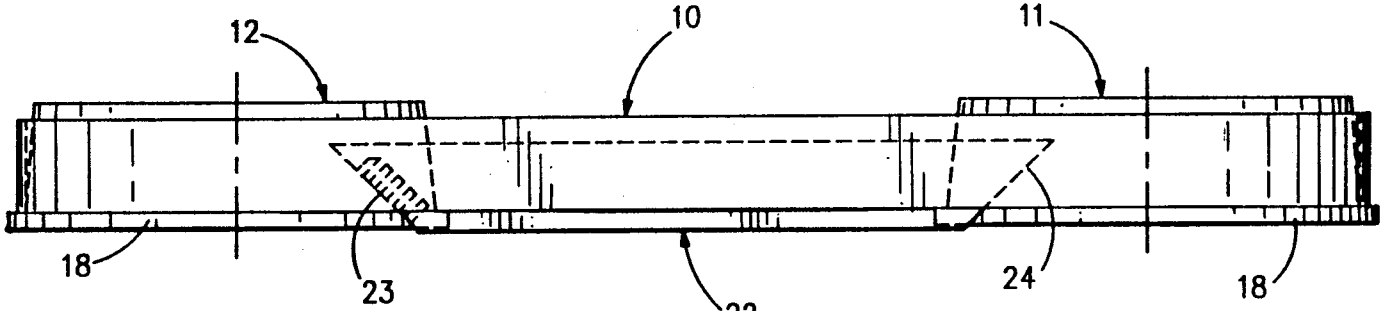
FIG. 2 is an edge view of a band drive and casting assembly for use in a printer of the type shown in FIG. 1.

Referring to FIG. 1, a printing apparatus comprises a flexible endless type band 10 constructed of, for example, nonferrous steel and having a row of type characters and a parallel row of timing marks (not shown) on the outer face of band 10. Band 10 is trained around a drive pulley 11 and a driven or idler pulley 12. Band 10 is driven by friction contact via a motor (not shown) which drives pulley 11. The pulleys are supported by shafts 13 and 14 journaled to a casting 15. Spring 17 applies tension to the band in a well known manner. The pulleys can have tapered drums to drive the type band 10 downward against pulley flanges 18 for maintaining vertical alignment of band 10. With this type of band drive there is a relatively long straight section in which printing takes places and in which the band faces the print line. During printing, band 10 is in motion at constant speed and selected hammers 19 are fired toward the band at a time at which a desired character on the band moves past the selected hammer. Between the type band 10 and hammers 19 is arranged a print medium 20 such as an ink ribbon and paper on which the characters are printed. As hammers 19 impact print medium 20 against the selected type band character, the hammer and band movement is limited by a platen 21 arranged behind band 10 and which generally is a stationary rigid metal plate. In the preferred embodiment, platen 21 takes the form of a horizontal flange **21*a* extending from one face and at the bottom edge of casting 15 with a bottom surface 21*b* forming an impact surface parallel to print line. A wear resistant strip 22 is fixed to and is fully coextensive with the impact surface 21*b* of the flange 21*a* and has a wear surface 22*a* which bears against the inside surface of band 10. Strip 22 can be any plastic material with good friction and wear properties and capable of withstanding impacts from hammers 19. Preferably strip 22 is a polymer and is fixed to impact surface 21*b* by bonding with an adhesive such as epoxy. As seen in FIG. 2, flange 21*a* and wear resistant strip 22 both have coincidental leading edges 23 and trailing edges 24 which are straight and slant in opposite directions relative to the direction of travel of band 10**.

Figure 6:
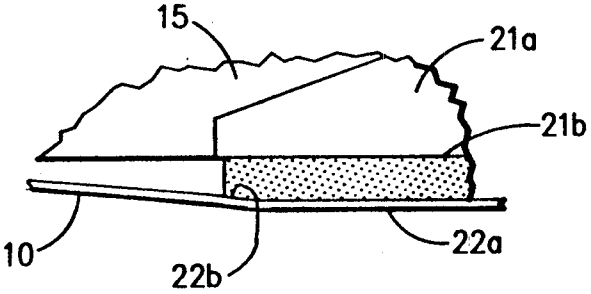
FIGS. 5 and 6 are fragments taken from FIG. 1 for illustrating initial and subsequent conditions of the wear resistant element of FIG. 3.
Figure 5:
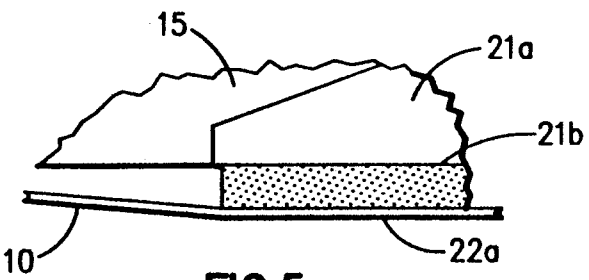

In the preferred manner in which the invention is practiced, the flange **21*a* and strip 22 are positioned so that the wear surface 22*a* is forward beyond the edge of casting 15 so that band 10 engages the leading edge 23 of strip 22 as it travels from idler pulley 12 to drive pulley 11. As a consequence, band 10 travels at an angle from idler pulley 12 across the slanted leading edge 23 and onto the wear surface 22*a* of strip 22. FIG. 5 shows the strip 22 in the initial unworn condition and FIG. 6, shows the condition of strip 22 after a period of operation. As seen, the wear surface 22***a* at the leading edge 23 is a tapered surface 22*b*. As a result of pulling of band 10 by drive pulley 11 across the leading edge 23 at an angle, the leading edge 23 wears and becomes tapered. The taper tends to be more severe at the leading edge 23 than at the trailing edge 24. Continuous sliding of band 10 on tapered surface produces a highly polished surface which it was found produces a very tight surface adherence between the band and the leading edge surface that is responsible for the excess frictional drag.

Figure 3:
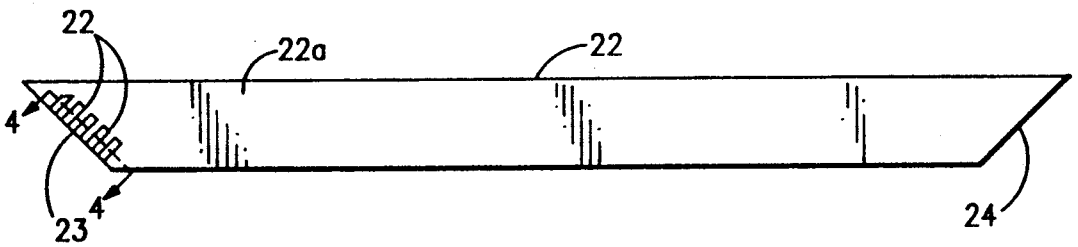
FIG. 3 is a plan view of the wear prevention element used in the assembly of FIG. 2.
Figure 4:
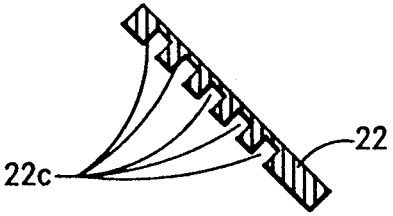
FIG. 4 is a section of the leading edge of the wear prevention element taken along line 4—4 in FIG. 3.

In accordance with the invention, the frictional drag is reduced to suitable levels by providing surface breaks formed at the leading edge of strip 22. As seen in FIGS. 2 and 3, the surface breaks take the form of grooves 22*c* which preferably run perpendicular to the leading edge 23. The grooves 22*c* themselves can take various form, but as shown in FIG. 4, they are rectangular grooves cut entirely through the leading edge 23 of strip 22 and are formed during the molding process of the strip 22.

A specific strip suitable for practicing the invention was made of polymer and had the following dimensions. Width $-\frac{3}{4}$ inches; thickness $-0.08$ inches; slant angle of leading edge $-45$ degrees; number of slots $-5$; width of slots $-0.060$ inches; depth of cut from leading edge $-0.040$ inches. Using such a strip, a DC brushless motor at a nominal voltage of 48 volts, had at an idle current of 1.5 to 2.5 amps. Before this invention, idle currents of 5–6 amps have been experienced.

Thus it will be seen that a printer apparatus is provided with an improved platen in a preferred embodiment which solves the problem of excessive frictional drag on the type band and it will be understood by persons skilled in the art that various changes in materials, structure and shape thereof may be made without departing from the invention either in spirit or in scope.

What is claimed is:

1. A printer apparatus comprising in combination a print band trained around a drive pulley and an idler pulley and along a print line, said print band being movable when driven in the direction leading along said print line from said idler pulley to said drive pulley, a plurality of print hammers mounted for impact with the print band along said print line, a platen having an impact surface positioned along said print line behind said print line, and a plastic wear prevention strip fixed on said platen impact surface for preventing direct frictional contact between said band and said impact surface, said strip having a wear surface in sliding engagement with said band with a leading edge of said strip being proximate said idler pulley, said sliding engagement producing a polished surface area on said wear surface at said leading of said strip as a result of said sliding engagement whereby a tight adherence of said band to said polished surface is produced, and groove means forming breaks in said leading edge and said polished surface area of said wear strip for reducing said tight adherence of said band to said polished surface of said wear strip and thereby reducing the frictional drag on said band, said leading edge being a straight edge extending across the path of and slanted relative to the direction of motion of said band, and said groove means being perpendicular to said straight edge.

2. A printer apparatus in accordance with claim 1 in which said plastic wear prevention strip is a polymer strip.

* * * * *